US005118162A

United States Patent [19]

Saul

[11] Patent Number: 5,118,162

[45] Date of Patent: Jun. 2, 1992

[54] BUMPER EDGE GUARD FOR UPHOLSTERED SEATING FURNITURE

[75] Inventor: Gregory M. Saul, Jefferson City, Tenn.

[73] Assignee: Shelby Williams Industries, Inc., Morristown, Tenn.

[21] Appl. No.: 431,989

[22] Filed: Nov. 6, 1989

[51] Int. Cl.[5] ..... A47B 95/00

[52] U.S. Cl. ..... 297/219; 248/345.1

[58] Field of Search ..... 297/218, 219, 220, 227, 297/396; 248/345.1; 5/424

[56] References Cited

U.S. PATENT DOCUMENTS

| | | | |
|---|---|---|---|
| 272,579 | 2/1883 | Paulding | 297/396 X |
| 2,418,092 | 3/1947 | Passel | 297/227 |
| 2,497,698 | 2/1950 | Struble et al. | 297/220 |
| 4,089,497 | 5/1978 | Miller et al. | 248/345.1 |
| 4,099,772 | 7/1978 | Barecki | 297/220 |
| 4,106,739 | 8/1978 | Gasser | 248/345.1 |
| 4,109,887 | 8/1978 | Wakeland, Jr. | 248/345.1 |
| 4,761,011 | 8/1988 | Sereboff | 297/396 X |

*Primary Examiner*—Peter R. Brown .

*Attorney, Agent, or Firm*—Silverman, Cass & Singer, Ltd.

[57] ABSTRACT

A bumper edge guard for the perimetric edges of seating furniture including a resilient foam insert for positioning about at least a portion of the perimeter of a support member of the furniture and encasing at least one edge of the portion of the perimeter of the support member and a substantially flexible protective member for securing to the support member and enclosing the foam insert between the support member and the protective member.

2 Claims, 1 Drawing Sheet

BUMPER EDGE GUARD FOR UPHOLSTERED SEATING FURNITURE

FIELD OF THE INVENTION

This invention relates generally to edge guards for the backrest part of upholstered seating furniture and more particularly, to a novel edge guard to be installed along the perimetric edges of the backrest of upholstered seating furniture, such as a couch, chair or the like. The edge guard is substantially resilient and transparent so as to provide protection against inadvertent abrasion of the backrest edges and surfaces against which the backrest may engage while at the same time permitting the upholstery to be visible along the perimetric edges so that the upholstery appears as a continuum of the upholstery covering the lateral surfaces of the backrest.

BACKGROUND OF THE INVENTION

Edge guards of the general type with which the invention is concerned are disclosed, for example, in U.S. Pat. No. 4,106,739 and other U.S. patents identified therein. Such edge guards are mounted along perimetric edges of the backrest part of the seating furniture which are covered with upholstery fabric and edge moldings to provide a finished effect.

The bumper edge guard embodying the invention provides significant advantages and benefits over the bumper edge member of U.S. Pat. No. 4,106,739. Specifically, the bumper edge guard embodying the invention provides for improved securement of the edge guard by hiding from view the fastening means and for exposing to view the upholstery fabric substantially as a continuum of the fabric covering the lateral surfaces of the backrest.

SUMMARY OF THE INVENTION

A bumper edge guard is disclosed for the perimetric edges of an article, such as the backrest part of an upholstered chair. A resilient foam insert is provided for positioning about at least a portion of the perimeter of a support member of the backrest and encasing at least one edge of the portion of the perimeter of the support member. A substantially transparent and flexible protective member also is provided for securing to the support member and enclosing the foam insert between the support member and the protective member. A first fabric portion having a desired color and/or pattern can be secured to the support member between the foam insert and the protective member so that the first fabric portion is visible through the protective member. The remaining portion of the support member can be covered with a second fabric portion having a color and/or pattern substantially matching or complementing the first fabric portion so that the first fabric portion beneath the protective member appears as a continuum of the second fabric portion to provide a finished effect to the backrest of the chair.

DESCRIPTION OF THE PREFERRED EMBODIMENTS

Figure 1:
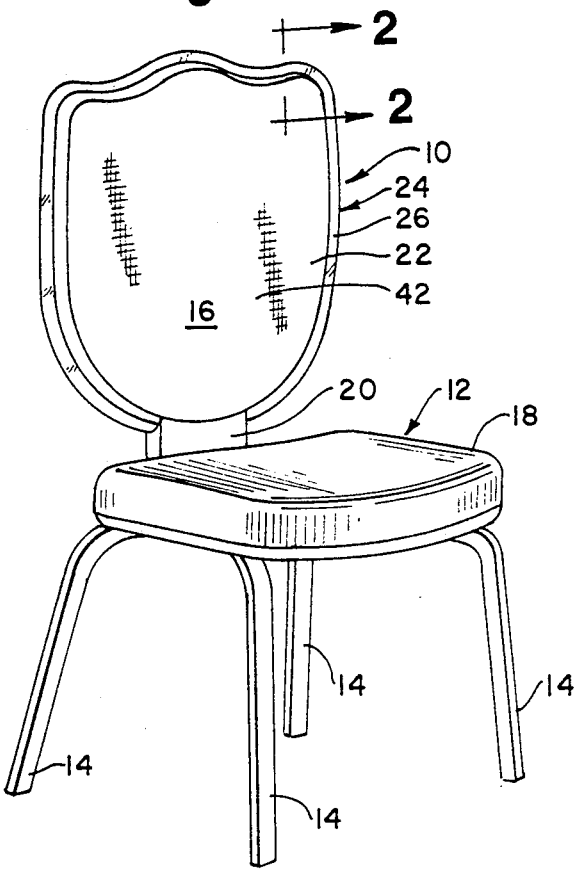
FIG. 1 is a perspective view of an upholstered chair having the edge guard embodying the invention secured about the edges of the backrest thereof.

Referring to FIG. 1, an upholstered piece of furniture, such as a chair, including the edge guard of the invention is designated generally by the reference numeral 10. The chair 10 preferably is an upholstered chair including a seat 12 having depending legs 14 and a backrest portion 16.

The seat 12 preferably is a padded seat having a foam and/or spring padding (not illustrated) which is covered with a desired piece of upholstery 18. It is to be understood, however, that the construction of the seat 12 can be modified and, if desired, can be unpadded.

The legs 14 are secured to the bottom of the seat 12 and can be constructed independently or can be formed by a pair of like inverted U-shaped members, each providing a pair of legs 14. The fastening of the legs 14 to the seat 12 as well as the specific design and material used for the legs 14 can vary.

The backrest portion 16 is secured to the seat 12 by a connecting member 20. The connecting member 20 preferably is somewhat flexible so that the backrest portion 16 can flex backward during use. The backrest portion 16 includes an interior portion 22 and a perimetric edge 24 which includes an edge guard 26 secured therearound.

Figure 2:
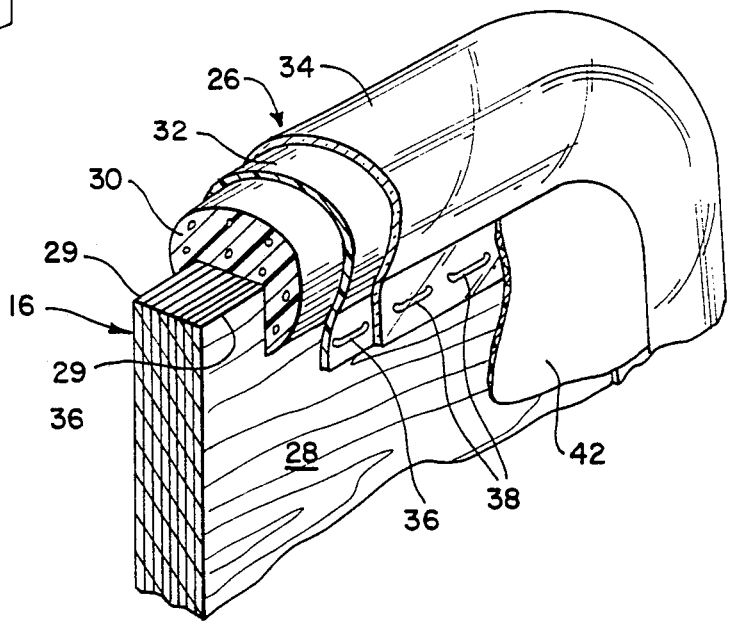
FIG. 2 is a fragmentary sectional perspective view taken along the line 2—2 of FIG. 1 and in the direction indicated generally.

As FIG. 2 illustrates, the backrest portion 16 is constructed from a support member 28 which preferably is made of plywood or similar material. Due to the thickness of the support member 28, two edges 29 are provided. The thickness as well as the size, shape and material used for the support member 28 can vary.

The edge guard 26 is positioned about the edges 29 of the support member 28 and includes a foam member or insert 30 which is covered by a first piece of upholstery fabric 32. The first piece of fabric 32 in turn is covered by a substantially clear, flexible protective member 34 which covers and protects the first piece of fabric 32, the foam member 30 and the support member 28.

The foam member 30 preferably is formed as a resilient foam extrusion and has a U-shaped cross-sectional configuration for mounting to and encasing the edges 29 of the support member 28. If desired, a fastener or an adhesive may be utilized to hold the foam member 30 in position as the first piece of fabric 32 is secured to the support member 28.

The first piece of fabric 32 preferably matches or complements the fabric or material of the remaining portions of the chair 10. Fasteners 36, such as staples, tacks or the like, are utilized to secure the first piece of fabric 32 to the support member 28 with the foam member 30 being captured therebetween.

The protective member 34 preferably is formed from extruded clear, flexible, soft, vinyl. It is to be noted, however, that the material for the protective member 34 can vary so long as it is substantially flexible. The protective member 34 is substantially clear so that the design or color of the first piece of fabric 32 is visible therethrough. The flexibility of the protective member 34 is necessary so that the protective member 34 can be pulled tightly over the first piece of fabric 32 and/or foam member 30 and around a corner of the support member 28 without any bulges or wrinkles. The protective member 34 likewise can be secured to the support member 28 by fasteners 38, such as staples, tacks or the like.

Figure 3:
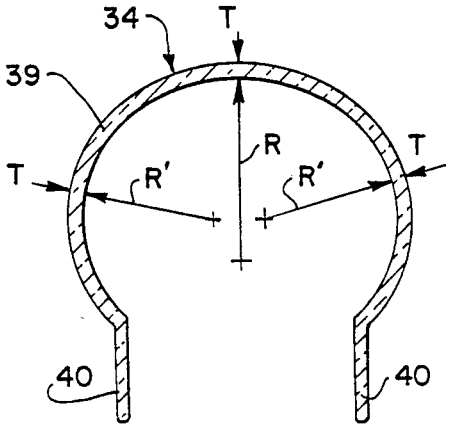
FIG. 3 is a cross-sectional view of the protective member of the invention.

As FIG. 3 illustrates, the protective member 34 is extruded in somewhat of a mushroom cross-sectional configuration having an elliptical shaped portion 39 and an open base with depending flanges 40. When assembled, the elliptical portion 39 accepts the foam member 30 therein and the flanges 40 are secured to opposite sides of the support member 28. It is to be noted that the radius R of the top center of the elliptical portion 39 is larger that the two side radiuses R' thereof. In order to eliminated any visible lines between the differing radiuses, the radiuses are blended where they meet to form a substantially continuous elliptical shape having a substantially constant thickness T.

As FIG. 1 illustrates, in order to finish the remaining area of the support member 28 to form the finished backrest portion 16, a second piece of fabric 42 with or without a second piece of padding (not illustrated) can be positioned within the interior portion 22 of the backrest portion 16 and fastened to the support member 28. The edges of the second piece of fabric 42 can cover the fasteners 38 of the protective member 34 and can be secured by fasteners 422 which preferably are not visible from the exterior of the backrest portion 16, such fastener also being covered by the second piece of fabric 42.

Preferably, the second piece of fabric 42 is fastened to the support member 28 by conventional upholstering methods as illustrated in FIGS. 1 and 2. For example, the outer edges of the second piece of fabric 42 first are secured to the support member 28 with fasteners. This upholstering continues around the periphery of the support member 28 along the edge of the protective member 34.

To assemble the edge guard 26 to the chair 10, the edges 29 of the support member 28 first are covered by the foam member 30. Next, the first piece of fabric 32 is positioned over the foam member 30 and is secured to the support member 28 by the fasteners 36. The protective member 34 then is positioned over the first fabric portion 32 and likewise is secured to the support member 28 by the fasteners 38. Finally, the second piece of fabric 42 and padding can be placed over the interior portion 22 of the backrest portion 16 and secured thereto while covering the fasteners 38.

Alternatively, the first piece of fabric 32 can be eliminated and the protective member 34 can be formed with a color and/or pattern which matches or complements the second piece of fabric 42.

Modifications and variations of the present invention are possible in light of the above teachings. For example, the edge guard 26 can be positioned on other portions of the chair 10, such as the seat 12, or on other types of upholstered furniture. It is therefore to be understood that within the scope of the appended claims, the invention may be practiced otherwise than as specifically described.

What is claimed and desired to be secured by Letters pPtent of the United States is:

1. A chair having a seat portion connected to a backrest portion which are to be upholstered and an edge guard for the perimetric edges of the backrest portion comprising:

a substantially rigid support member for providing structural support to said backrest portion;

a foam insert having a cross-sectional configuration which is substantially U-shaped positioned about the perimetric edges of said support member with said edges of said support member being received within said U-shaped foam insert;

a first fabric portion having a desired color and/or pattern positioned over said foam insert;

first fastening means for securing said first fabric portion to said support member with said foam insert being captured therebetween;

a substantially transparent and flexible protective member positioned over said first fabric portion and said foam insert;

second fastening means for securing said protective member to said support member with said first fabric portion and said foam insert being captured therebetween so that said first fabric portion is visible through said protective member;

a second fabric portion for covering the remaining portion of said support member exterior of said protective member, said second fabric portion having a color and/or pattern substantially matching or complementing said first fabric portion; and third fastening means for securing said second fabric portion to said support member so that said second fabric portion encloses said second fastening means and said third fastening means, and said first fabric portion appears as a continuum of said second fabric portion to provide a finished effect to said backrest portion of said chair.

2. The chair as defined in claim 1 wherein said protective member is extruded from clear soft vinyl and is formed with a substantially mushroom shaped cross-sectional configuration having an elliptical portion for accepting said U-shaped foam insert therein and being open along its base and having a pair of depending flanges for securing said protective member to opposite sides of said support member.

* * * * *